US007905124B2

(12) United States Patent
Komemi

(10) Patent No.: US 7,905,124 B2
(45) Date of Patent: Mar. 15, 2011

(54) LOCK WITH A TOOL AND METHOD OF FORMING THE LOCK

(76) Inventor: Rahamim Komemi, Jerusalem (IL)

( * ) Notice: Subject to any disclaimer, the term of this patent is extended or adjusted under 35 U.S.C. 154(b) by 133 days.

(21) Appl. No.: 12/365,904

(22) Filed: Feb. 5, 2009

(65) Prior Publication Data

US 2010/0192651 A1 Aug. 5, 2010

(51) Int. Cl.
*E05B 27/06* (2006.01)

(52) U.S. Cl. ..... 70/358; 70/375; 70/372; 70/382; 70/DIG. 44; 29/804; 81/3.55

(58) Field of Classification Search ..... 70/358, 70/375, 372, 378, 382–385, 431, DIG. 15, 70/DIG. 44, DIG. 75; 29/464, 804, 281.1, 29/271, 272, 434, 468, 436, 225, 253; 33/539, 33/540; 81/3.55, 3.57, 3.36, 367, 375, 488, 81/15.9

See application file for complete search history.

(56) References Cited

U.S. PATENT DOCUMENTS

| | | | | | |
|---|---|---|---|---|---|
| 3,111,748 | A * | 11/1963 | Doll et al. | ..... | 29/712 |
| 3,417,452 | A * | 12/1968 | Roland | ..... | 29/804 |
| 3,750,500 | A | 8/1973 | Peterson | | |
| 4,434,636 | A * | 3/1984 | Prunbauer | ..... | 70/358 |
| 4,680,860 | A * | 7/1987 | Detloff | ..... | 29/804 |
| 4,714,386 | A | 12/1987 | Phillips | | |
| 4,741,188 | A | 5/1988 | Smith | | |
| 4,836,002 | A | 6/1989 | Monahan | | |
| 4,836,060 | A | 6/1989 | Klefbeck | | |
| 5,050,412 | A * | 9/1991 | Errani | ..... | 70/358 |
| 5,079,936 | A * | 1/1992 | Stefanek | ..... | 70/358 |
| 5,211,044 | A | 5/1993 | Kim | | |
| 5,531,084 | A * | 7/1996 | Laabs et al. | ..... | 70/409 |
| 5,752,400 | A * | 5/1998 | Kim | ..... | 70/368 |
| 5,775,144 | A * | 7/1998 | Pagalday | ..... | 70/358 |
| 5,921,122 | A * | 7/1999 | Lin | ..... | 70/368 |
| 6,021,655 | A * | 2/2000 | Labbe et al. | ..... | 70/493 |
| 6,295,725 | B1 * | 10/2001 | King et al. | ..... | 29/804 |
| 6,305,886 | B1 | 10/2001 | Womack | | |
| 6,519,988 | B1 * | 2/2003 | Wu | ..... | 70/358 |
| 6,935,146 | B1 * | 8/2005 | Lin | ..... | 70/338 |
| 7,685,853 | B2 * | 3/2010 | Burkart | ..... | 70/375 |
| 2001/0029761 | A1 * | 10/2001 | Hwang et al. | ..... | 70/358 |
| 2006/0021406 | A1 | 2/2006 | Herdman | | |

* cited by examiner

*Primary Examiner* — Suzanne D Barrett
(74) *Attorney, Agent, or Firm* — Robert G. Lev

(57) ABSTRACT

A pin tumbler lock having a housing with a series of holes running parallel to the longitudinal axis of the cylindrical bore in the housing. The holes are bored through the housing, and a first end of each hole opens to one of each of the chambers in the housing, between the first and second ends of the corresponding chamber, and a second end of each hole opens to the outside of said housing. A tool having a body comprising a tumbler-lock-housing receiving cavity, for receiving the housing therein, wherein the body comprises a first and second series of channels for creating the holes in a conventional pin tumbler lock housing.

11 Claims, 5 Drawing Sheets

SECTION C-C

LOCK WITH A TOOL AND METHOD OF FORMING THE LOCK

FIELD OF INVENTION

The present invention relates to the field of locks. In particular, the present invention relates to pin tumbler locks. More particularly, the present invention relates to a novel lock housing for enabling easy repair, and method for forming the novel lock housing from a conventional lock housing.

BACKGROUND OF INVENTION

A pin tumbler lock is a type of lock mechanism, typically used in cylinder locks, in which pins of varying lengths must be aligned in order to allow a lock plug cylinder to rotate. The pin tumbler cylinder lock comprises a housing having a cylindrical bore in which the lock plug cylinder is removably inserted. The lock plug cylinder contains a plurality of openings that are initially positioned beneath and aligned with a plurality of chambers in the housing. Each pin chamber contains a pin stack, which consists of at least: a key pin, located entirely within the lock plug cylinder; a driver pin, located partially within the cylinder and partially within the chamber, for preventing the cylinder from rotating; and, a compression spring, located within the chamber. When a correct key is inserted to the lock plug cylinder, the peaks and valleys of the key raise and lower the pin stack as appropriate, so as to situate the driver pins entirely within the chamber, thereby allowing the lock plug cylinder to rotate. In more complicated locks, additional pin stack elements may be present, such as spacer pins.

Malfunctions of a pin tumbler lock can take various forms. One example of a common malfunction is a chamber jam, wherein one or more components of the pin stack get stuck within the chamber of a lock housing. In this case, the only way of repairing the jam is to remove the lock plug and then remove the pin stack components through the empty cylindrical bore. Due to the small space of the bore, and the 90 degree angle of the chamber with respect to the bore, there exist difficulties when trying to remove the pin stack components from the chamber. Therefore, the lock is often discarded and replaced to avoid the difficulties involved with attempting to fix it.

The inventor of the present invention is aware of a single prior art lock that superficially appears similar to the novel lock of the present invention, however, upon inspection, the prior art lock is quite dissimilar to the present invention in both form and function.

U.S. Pat. No. 5,921,122 to Lin, discloses a device for preventing the upper pin tumblers from falling while replacing the lock plug. A lock is disclosed comprising a number of longitudinally spaced holes in communication with the lower end of an associated upper chamber. A fork device having a number of branches is removably insertable into an associated hole to support the associated upper pin tumbler during replacement of the lock plug. The longitudinally spaced holes are bored in the housing at a 90 degree angle with respect to the associated chamber (see FIG. 5). Additionally, the holes must intersect with the shear (or, split) line of the lock for separating the upper pin tumblers from the lower pin tumblers. According to the present invention, as described herein below, the holes in the housing intersect with corresponding chambers between the upper and lower ends of the chamber, and are preferably angled away from the lower end of the chamber, and towards the upper end of the chamber.

It is therefore an object of the present invention to provide a novel lock for enabling a chamber jam to be easily repaired.

It is an additional object of the present invention to provide a novel lock that may be formed out of a conventional prior art lock.

It is yet an additional object of the present invention to provide a tool for forming the novel lock of the present invention.

Additional objects and advantages of the present invention are described in detail herein below.

SUMMARY OF INVENTION

The present invention relates to a pin tumbler lock having a housing comprising a cylindrical bore adapted to receive a lock plug, and further comprising a series of chambers located in said housing running parallel to the longitudinal axis of said cylindrical bore, wherein each chamber radially extends from said cylindrical bore through said housing, and wherein each of said chambers is adapted to receive a pin stack, and wherein a first end of each chamber opens to said cylindrical bore and a second end of each chamber opens to the outside of said housing; and, wherein said housing further comprises a series of holes running parallel to the longitudinal axis of said cylindrical bore, wherein said holes are bored through said housing, and wherein a first end of each hole opens to one of each of said chambers, between said first and second ends of the corresponding chamber, and a second end of each hole opens to the outside of said housing.

According to the preferred embodiment, the first end of each hole is angled toward the second end of its corresponding chamber, and preferably, the angle of each hole with respect to its corresponding chamber is greater than 90 degrees.

The present invention further relates to a tool for forming the series of holes in the housing, wherein said tool has a body comprising a tumbler-lock-housing receiving cavity, for receiving said housing therein, and further comprising a first and second series of channels running longitudinally along said body, wherein each channel is bored through said body, and wherein both series of channels are positioned along a single longitudinal side of said body, and wherein a first end of each channel of said first series opens to said receiving cavity and a second end of each channel of said first series opens to the outside of said tool, and wherein a first end of each channel of said second series opens to said receiving cavity and a second end of each channel of said second series opens to the outside of said tool, wherein the first end of each channel of said first series intersects with the first end of one of each channel of said second series, wherein said first and second series of channels are for forming said series of holes in said housing.

Preferably, a third series of channels runs longitudinally along the body, wherein each channel is bored through said body, wherein each channel of said third series radially extends from the receiving cavity through said body, and wherein a first end of each channel of said third series opens to said receiving cavity and a second end of each channel of said third series opens to the outside of said tool.

The tool comprises a front end into which the housing is inserted prior to forming the holes, and a second end, wherein said second end comprises an end stopper for preventing said housing from extending past said back end of said tool.

The end stopper preferably comprises a slab fixedly abutting the back end of said tool.

The longitudinal side of the body of said tool opposing the side comprising the first and second series of channels comprises holding means for fixedly maintaining the housing within the receiving cavity, said holding means comprising at least one threaded hole and screw for inserting into said hole such that the tip of said screw presses said housing against the inside wall of the receiving cavity of said tool.

The present invention also relates to a method of forming the series of holes in the housing, wherein said method comprises the following steps of:

a. inserting said housing in the tumbler-lock-housing receiving cavity of the tool;

b. aligning said housing within said cavity;

c. preferably drilling a notch in said housing through a first channel of the first series of channels in said tool;

d. drilling a hole at said notch in said housing through a first channel of the second series of channels; and, e. repeating steps c and d for remaining channels in said first and second series of channels.

The method of alignment in step b is performed by positioning the end of the housing planar with the back end of the tool.

Alternatively, the alignment in step b is performed by positioning each chamber of the housing aligned with one of each channel in the third series of channels in the tool.

DETAILED DESCRIPTION OF THE PREFERRED EMBODIMENTS

A conventional pin tumbler lock may malfunction in a variety of ways. One example of a common malfunction is when one element of a pin stack becomes jammed within its chamber. When this occurs, a locksmith will typically recommend replacing the tumbler lock instead of attempting to repair it due to the difficulties involved. The present invention provides a novel tumbler lock for enabling a chamber jam to be easily repaired, and a tool and a method of forming the novel lock housing out of a conventional tumbler lock housing.

The term, "longitudinal side" as used herein with reference to the novel lock housing and the tool for forming the housing, refers to one of the two opposing longitudinal sides of the housing or tool with respect to its longitudinal axis. Thus, one longitudinal side may comprise more than one surface, i.e. surfaces positioned at different angles with respect to the longitudinal axis of the housing or tool, yet considered a single longitudinal side.

The pin tumbler lock shown in the figures herein is a single lock, for a single side key entry. It is understood that the present invention relates equally to a double lock, for two sided key entry, mutatis mutandis.

Figure 1:
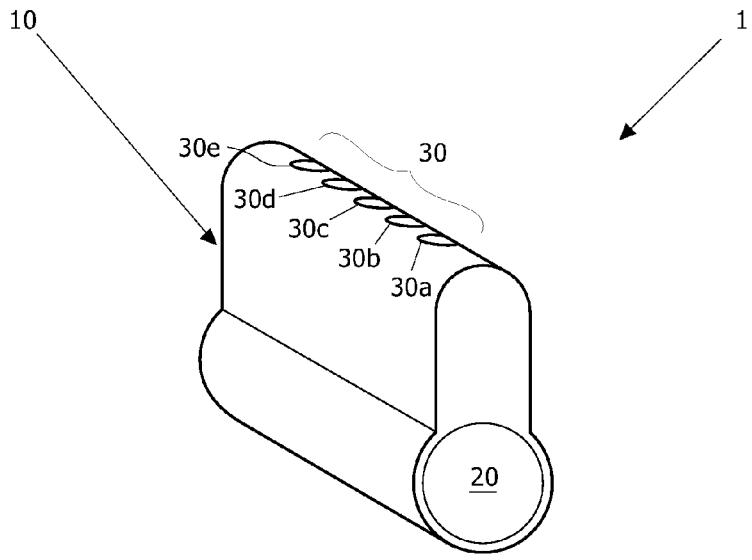
PRIOR ART Fig. 1
FIG. 1 shows a perspective view of a prior art tumbler pin lock.

A conventional prior art pin tumbler lock (1) is shown in FIG. 1 for the purpose of comparison with the present invention. Prior art lock (1) has a housing (10) comprising a cylindrical bore (20), in which a lock plug (not shown) is disposed when the pin tumbler lock is fully assembled, and a series of chambers (30), wherein in each chamber (30*a*-30*e*) is disposed a pin stack (not shown in this figure) when the pin tumbler lock is fully assembled.

It should be noted that the orientation of a tumbler lock within a door is typically (although not necessarily) in a manner such that the cylindrical bore portion is vertically above the narrower portion of the housing, with respect to the ground (i.e. a 180 degree rotation of what is shown in the figures). However, for the purposes of clarity in the illustrative depiction of the present invention, the housing is oriented as shown.

Figure 2:
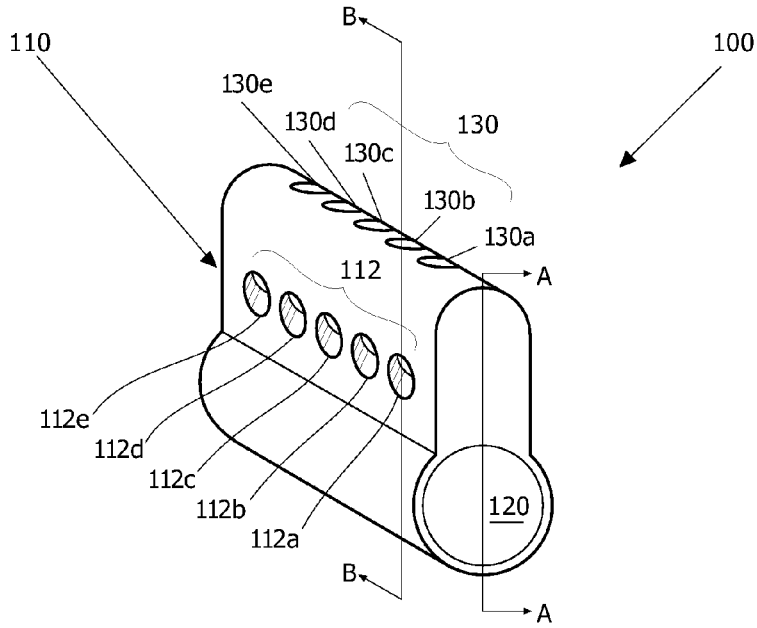
FIG. 2 shows a perspective view of the tumbler pin lock of the present invention.

A preferred embodiment of the novel pin tumbler lock of the present invention is shown in a perspective view in FIG. 2, and generally designated by numeral (100). Pin tumbler lock (100) has a housing (110) comprising a cylindrical bore (120), in which a lock plug (not shown) is disposed when lock (100) is fully assembled, and a series of chambers (130), wherein in each chamber (130*a*-130*e*), is disposed a pin stack (not shown in this figure) when lock (100) is fully assembled. A series of holes (112) is bored through one longitudinal side of housing (110). Each hole (112*a*-*e*) is associated with a corresponding chamber (130*a*-*e*), for enabling the unblocking of a jam in one of the chambers (130*a*-130*e*), as described in greater detail herein below.

Figure 3:
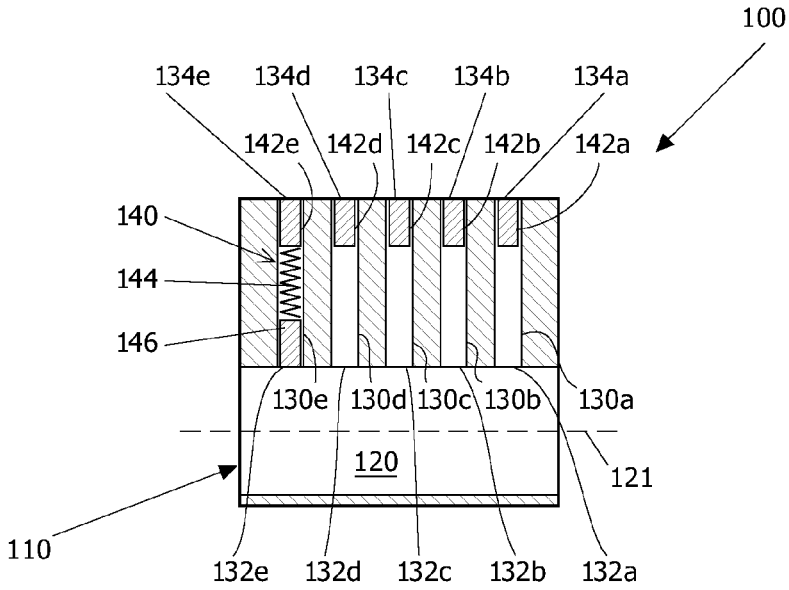
FIG. 3 shows a cross-sectional view along the longitudinal axis of the housing of the tumbler pin lock of the present invention.

A cross-sectional view of housing (110) of FIG. 2 is taken along its longitudinal axis, and shown in FIG. 3, illustrating stopper pins (142*a*-*e*) disposed within corresponding chambers (130*a*-*e*). As is seen in the figure, the series (or, row) of chambers (130) runs essentially parallel to the longitudinal axis (121) of cylindrical bore (120). Each chamber (130*a*-*e*) radially extends from cylindrical bore (120) through housing (110). A first end (132*a*-*e*) of each chamber (130*a*-*e*) opens to cylindrical bore (120) and a second end (134*a*-*e*) of each chamber (130*a*-*e*) opens to the outside of housing (110). As mentioned herein above, when lock (100) is fully assembled a pin stack is disposed within each chamber (130*a*-*e*). One chamber (130*e*) is shown in the figure, as an illustrative example, with a pin stack (140) disposed therein. Pin stack (140) in chamber (130*a*) comprises a stopper pin (142*e*) a spring (144) and a driver pin (146), although additional and/or alternative components may be included in other pin stacks according to the present invention.

It should be noted that although the description and figures herein refer to pin stoppers, alternatively shaped stoppers, such as ball stoppers, etc., are understood to equally fall within the scope of the present invention.

As mentioned herein above, the present invention enables easy repairing of a tumbler lock malfunction, particularly one that occurs due to a jam of pin stack components in a chamber. In a conventional prior art tumbler lock housing, it is not easy to access the chambers via the cylindrical bore. Hence, any blockage that occurs in the chamber is very difficult, if at all possible, to clear. It is more time and cost efficient for a locksmith to replace the lock than to spend the time attempting to repair it. The present invention provides an alternate access to the chamber, thereby bypassing the cylindrical bore. This allows the locksmith to easily repair the malfunctioned lock, and save the customer money in the process.

Figure 4:
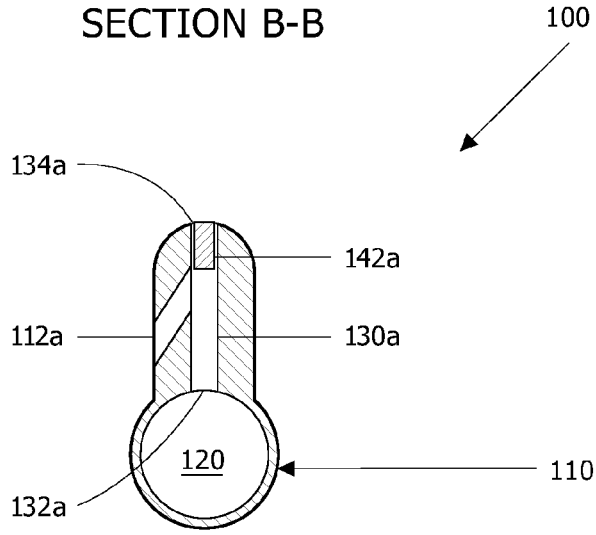
FIG. 4 shows a transverse cross-sectional view taken along a chamber and a hole bored through housing of the present invention

FIG. 4 shows a transverse cross-sectional view of the present invention (100) taken across chamber (130*a*) and hole (112*a*) of FIG. 2. Hole (112*a*) is shown bored at an angle such that an elongated rigid object, for example, a drill bit, may be inserted into hole (112*a*), and driven towards stopper pin (142*a*), in order to push stopper pin (142*a*) out of the opening at second end (134*a*) of chamber (130*a*). Hole (112*a*) is directed away from first ("lower") end (132*a*) of chamber (130*a*), and towards second ("upper") end (134*a*) of chamber. The angle of hole (112*a*) with respect to second end (134*a*) of chamber (130*a*) is greater than 90°, and preferably greater than 100°. The precise angle of hole (112*a*) with respect to second end (134*a*) of chamber (130*a*) is not required in order to define the present invention. However, the general requirement is for the elongated rigid object to preferably be a linear rod (not shown), which is to be able to pass through hole (112*a*) and out of second end (134*a*) of chamber (130*a*) without bending. Alternatively, depending on the material from which the rod is made, as well as the shape of rod, bending may occur in order to be passed through hole (112*a*) and out of second end (134*a*) of chamber (130*a*).

Once the stopper pin is removed from its chamber, access to the chamber may be achieved via the second end of the chamber. Repair may be performed, by, for instance, removing the components of the pin stack contained in the chamber either through the second end, or by pushing the components out of the first opening and removing them via the cylindrical bore.

It should be noted that the series of holes (112) may be located on either one or both longitudinal sides of housing (110). In addition, it is understood that the description and depiction of the features of chamber (112*a*) and hole (130*a*) is illustrative of each of the other chambers (112*b-e*) and holes (130*b-e*), respectively.

Figure 5:
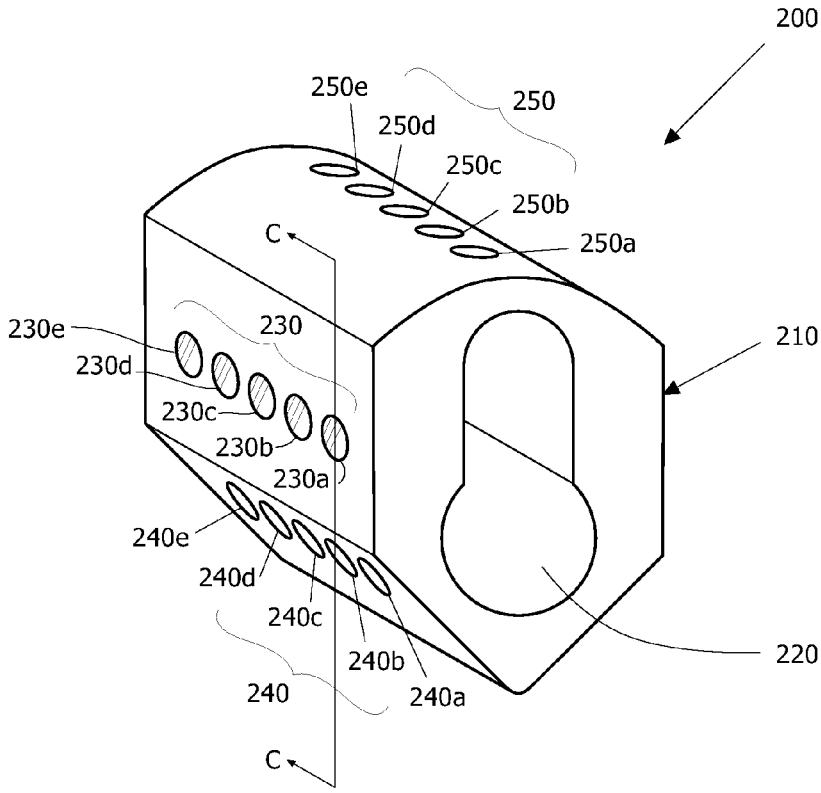
FIG. 5 shows a front perspective view of a first side of the tool utilized for forming the lock of the present invention.

The present invention further provides a tool for forming the lock housing (100) of the present invention. The preferred embodiment of the tool is shown in FIG. 5 in a front perspective view from a first longitudinal side, and generally designated by numeral (200). Tool (200) has a body (210) comprising a tumbler-lock-housing receiving cavity (220) in which a conventional prior art tumbler lock housing may be disposed, as described herein below. A first series (230) and second series (240) of channels are bored through body (210) for forming holes (112*a-e*, see FIG. 2), as described further, herein below.

Also shown in FIG. 5 is an optional third series of channels (250) for aligning with the corresponding openings at the second ends of the series of chambers of a lock housing, as described herein above, when the lock housing is disposed within receiving cavity (220).

Cavity (220) is shown in the figures having a profile with dimensions adapted for receiving a lock housing as illustrated in the figures herein, however, it is understood that cavity (220) may have any suitable profile for receiving a corresponding lock housing.

Figure 6:
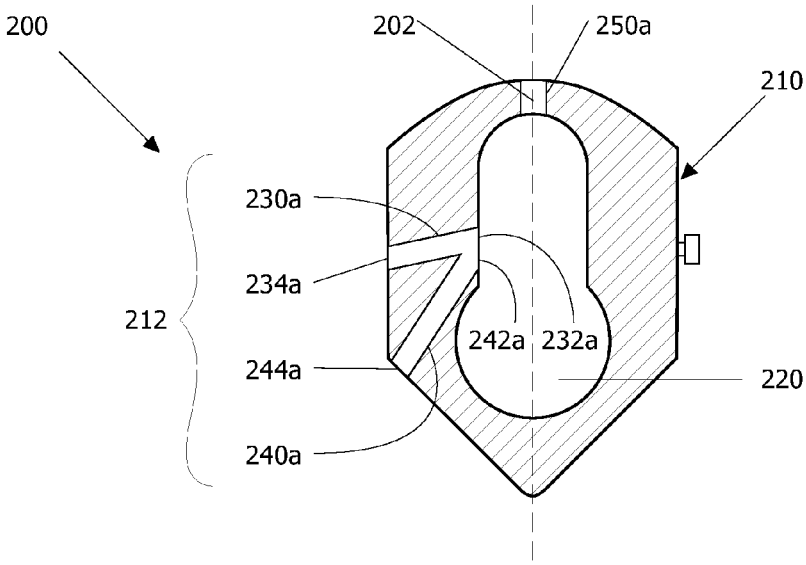
FIG. 6 shows a transverse cross-sectional view of the tool of the present invention, taken along the first channel of each of the three series of channels.

A transverse cross-sectional view of tool (200) is shown in FIG. 6, taken along first, second and third channels (230*a*), (240*a*), (250*a*) in respective first, second and third series of channels (230), (240), (250). As is seen in FIGS. 5 and 6, both first and second series of channels (230), (240) are positioned along a single longitudinal side (212) of body (210). As best seen in FIG. 6, the first end (232*a*) of first channel (230*a*) of first series of channels (230) opens to receiving cavity (220), and the first end (242*a*) of second channel (240*a*) of second series of channels (240) opens to receiving cavity (220). The second end (234*a*) of first channel (230*a*) of first series of channels (230) opens to the outside of tool (200), and the second end (244*a*) of second channel (240*a*) of second series of channels (240) opens to the outside of tool (200).

Still referring to FIG. 6, first end (232*a*) of first channel (230*a*) of first series (230) intersects and overlaps with the first end (242*a*) channel (240*a*) of second series (240). First channel (230*a*) is preferably bored at an angle of 90° or greater with respect to the longitudinal axis (202) of third channel (250*a*) of third series of channels (250). Second channel (240*a*) is preferably bored at an angle such that an elongated rigid object, for example, a drill bit, may be inserted therein, and extended through third channel (250*a*).

It is understood that the description and depiction of the features of channels (230*a*), (240*a*) as described herein above are illustrative of each of the other channels (230*b-e*), (240*b-e*), respectively.

Figure 7:
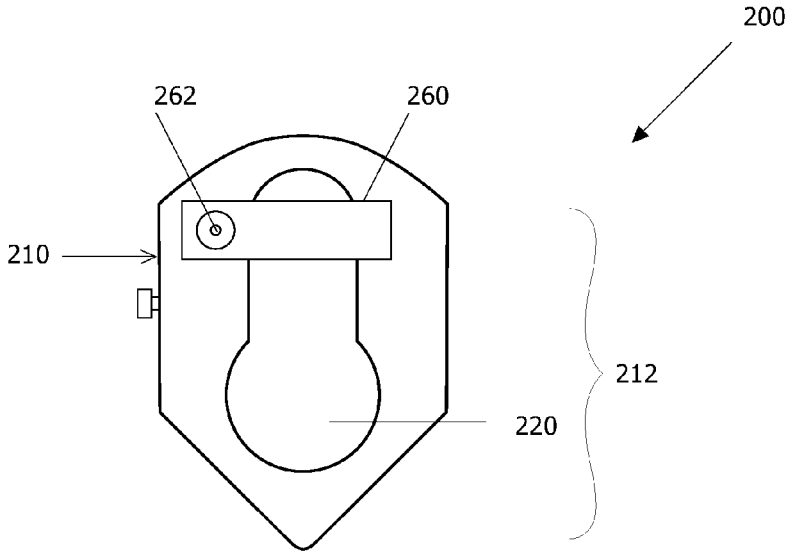
FIG. 7 shows a back view of the tool of FIG. 5.

Tool (200) comprises two additional features that are important for forming the holes of the present invention. Firstly, referring to FIG. 7, showing the back view of body (200), an end stopper (260) is positioned abutting the back surface (212) of body (210). End stopper (260) is shown in the figure comprising a rigid aluminum slab, which is fixedly joined to body (210) via a screw (262) that is drilled into body (210). Alternatively, stopper (260) may comprise any alternative component for preventing the end of housing inserted to cavity (220) from protruding from cavity (220) past back surface (212), and may be joined to body (210) by any alternative means such as glue, welding, etc. Alternatively, cavity (220) is closed at its back end, such that the end stopper is essentially the back wall of cavity (220) of tool (200).

Figure 8:
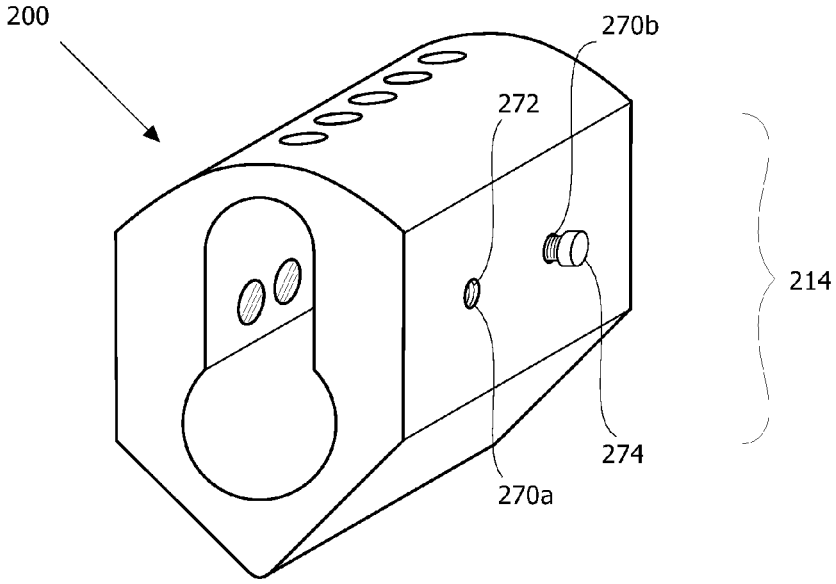
FIG. 8 shows a front perspective view of a second side of the tool utilized for forming the lock of the present invention.

A second additional feature of tool (200) includes means to hold a lock housing within cavity (220). FIG. 8 shows a front perspective view of tool (200) from a second longitudinal side. Two holes (270*a*), (270*b*) are bored through the side wall (214), spaced longitudinally from each other, preferably parallel to the longitudinal axis of tool (200). Internal threads (272) are shown in the empty first hole (270*a*), and a screw (274) is shown threaded in second hole (270*b*). When a lock housing is disposed in cavity (220), screw (274) is rotated such that its tip (not shown) shifts towards cavity (220), in order to press and hold the lock housing in a fixed position for drilling holes into the lock housing, as described herein below. A similar screw to that of screw (274) is preferably inserted into hole (270*a*) when in use for further maintaining the lock housing disposed in cavity (220) in a fixed position. According to an alternative embodiment, only one hole and screw are present in tool (200). Alternatively, no screws are present, and the lock housing is held in place either manually or by another tool such as a vise, etc.

Figure 9:
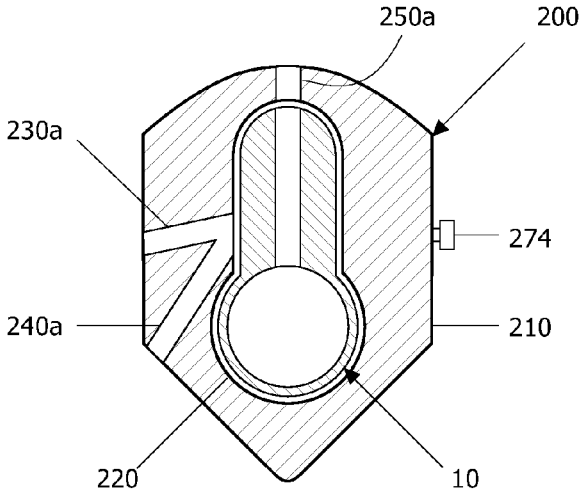
FIG. 9 shows a cross-sectional view of a prior art lock housing situated within the cross-sectional view of the tool of FIG. 6.

With reference to FIG. 9, a transverse cross-section of prior art lock housing (10) (see FIG. 1) taken along chamber (30*a*) is shown disposed in the cross-sectional view of tool (200) of FIG. 6. In order to form bored holes in a conventional prior art lock housing (10), housing (10) is first disposed within cavity (220) of tool (200) and positioned such that the end of housing (10) inserted in cavity (220) reaches end stopper (260), such that chambers (30*a-e*) are aligned with respective channels (250*a-e*) of tool.

In the preferred embodiment, screw (274) is rotated as described above in order to hold housing (10) in a fixed position within cavity (220).

It should be noted that the space shown in cavity (220) between lock housing (10) and body (210) is exaggerated for illustrative purposes. In actuality, at least a portion of housing (10) is positioned flush against at least a portion of body (210).

Figure 10:
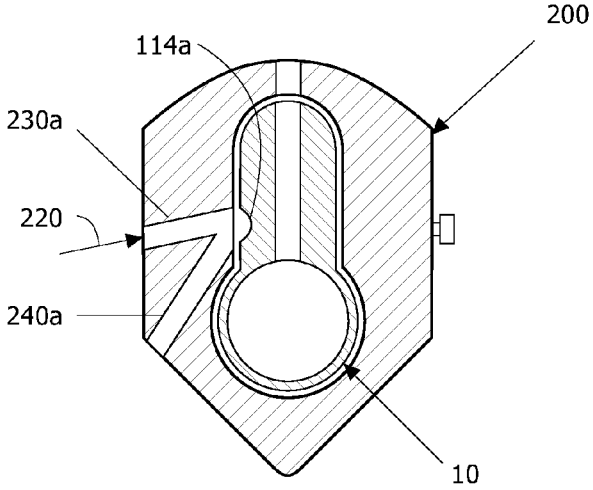
FIG. 10 shows the view of FIG. 9, with a priming notch in the housing; and, FIG. 11 shows the view of FIG. 9, with a hole bored in the housing through the tool.

In general, when drilling on a surface at an angle, it is preferable to first form a priming notch in the surface at the point where the drilling is desired in order to prevent slippage of the drill bit along the surface at first contact. The notch serves to catch and guide the drill bit at the desired drilling point. To that end, referring to FIG. 10, a notch (114*a*) is preferably formed by drilling through channel (230*a*), as indicated by arrow (202), for assisting in the drilling of a hole in housing (10) through channel (240*a*), as described herein below.

Figure 11:
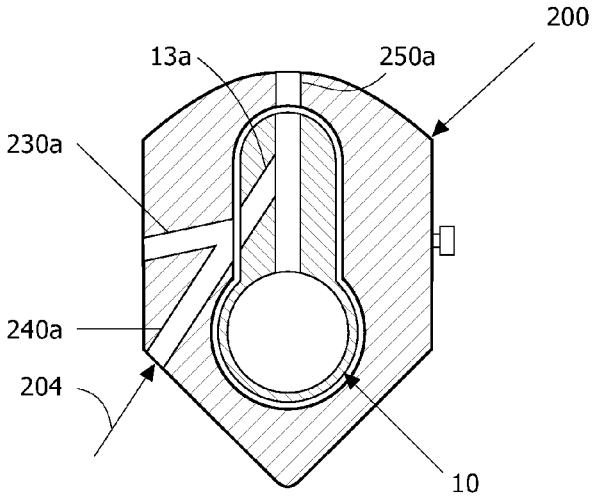

Referring to FIG. 11, a hole (13*a*) is drilled in housing (10) through channel (240*a*), as indicated by arrow (204), thereby forming the first hole (13*a*) of the lock housing of the present invention. It is understood that additional holes are drilled through the corresponding channels of tool (200).

Once the stopper pin is removed from its chamber, access to the chamber may be achieved via the second opening of the chamber. Repair may be performed, by, for instance, removing the components of the pin stack contained in the chamber either through the second opening, or by pushing the components out of the first opening and removing them via the cylindrical bore.

As mentioned above, third series of channels (250) is only optionally (although preferably) present in tool (200). This is because in order to drill the holes within the lock housing, channels (250) are not required. Channels (250) merely assist in the alignment of the housing within the tool cavity, but such alignment may be performed without the use of channels (250).

In the preferred embodiment, wherein channels (250) are present, channels (250) may be used for replacing the pin stoppers in their respective chambers within the housing. Channels (250) are preferably threaded, such that a screw (not shown, but preferably similar to screw (274)) may be inserted therein. A pin stopper is positioned on top of the second end of a chamber, and the screw is rotated in the corresponding channel (250*a-e*), thereby forcibly pushing the pin stopper into position within its chamber in the lock housing.

As seen in FIGS. 5-11, the lower end of tool (200) narrows to form a triangular tip. This geometrical configuration is preferred as it enables tool (200) to be fixedly held by a holding tool during the drilling process, however, any alternative configuration may be utilized for alternative holding means.

It is understood that the above description of the embodiments of the present invention are for illustrative purposes only, and is not meant to be exhaustive or to limit the invention to the precise form or forms disclosed, as many modifications and variations are possible. Such modifications and variations are intended to be included within the scope of the present invention as defined by the accompanying claims.

The invention claimed is:

1. A pin tumbler lock having a housing comprising a cylindrical bore adapted to receive a lock plug, and further comprising a series of chambers located in said housing running parallel to the longitudinal axis of said cylindrical bore, wherein each chamber radially extends from said cylindrical bore through said housing, and wherein each of said chambers is adapted to receive a pin stack, and wherein a first end of each chamber opens to said cylindrical bore and a second end of each chamber opens to the outside of said housing; and wherein said housing further comprises a series of holes running parallel to the longitudinal axis of said cylindrical bore, wherein said holes are bored through said housing, and wherein a first end of each hole opens to one of each of said chambers, between and not overlapping with said first and second ends of the corresponding chamber, and a second end of each hole opens to the outside of said housing.

2. A pin tumbler lock according to claim 1, wherein the first end of each hole is angled toward the second end of its corresponding chamber.

3. A pin tumbler lock according to claim 1, wherein the angle of each hole with respect to its corresponding chamber is greater than 90 degrees.

4. A tool for forming the series of holes in the housing according to claim 1, wherein said tool has a body comprising a tumbler-lock-housing receiving cavity, for receiving said housing therein, and further comprising a first and second series of channels running longitudinally along said body, wherein each channel is bored through said body, and wherein both series of channels are positioned along a single longitudinal side of said body, and wherein a first end of each channel of said first series opens to said receiving cavity and a second end of each channel of said first series opens to the outside of said tool, and wherein a first end of each channel of said second series opens to said receiving cavity and a second end of each channel of said second series opens to the outside of said tool, wherein the first end of each channel of said first series intersects with the first end of one of each channel of said second series, wherein said first and second series of channels are for forming said series of holes in said housing.

5. A tool according to claim 4, wherein a third series of channels runs longitudinally along the body, wherein each channel is bored through said body, wherein each channel of said third series radially extends from the receiving cavity through said body, and wherein a first end of each channel of said third series opens to said receiving cavity and a second end of each channel of said third series opens to the outside of said tool.

6. A tool according to claim 4, wherein the tool comprises a front end into which the housing is inserted prior to forming the holes, and a second end, wherein said second end comprises an end stopper for preventing said housing from extending past said back end of said tool.

7. A tool according to claim 6, wherein the end stopper comprises a slab fixedly abutting the back end of said tool.

8. A tool according to claim 4, wherein the longitudinal side of the body of said tool opposing the side comprising the first and second series of channels comprises holding means for fixedly maintaining the housing within the receiving cavity, said holding means comprising at least one threaded hole and screw for inserting into said hole such that the tip of said screw presses said housing against the inside wall of the receiving cavity of said tool.

9. A method of forming the series of holes in the housing of a pin tumbler lock having a housing comprising a cylindrical bore adapted to receive a lock plug, and further comprising a series of chambers located in said housing running parallel to the longitudinal axis of said cylindrical bore, wherein each chamber radially extends from said cylindrical bore through said housing, and wherein each of said chambers is adapted to receive a pin stack, and wherein a first end of each chamber opens to said cylindrical bore and a second end of each chamber opens to the outside of said housing; and wherein said housing further comprises a series of holes running parallel to the longitudinal axis of said cylindrical bore, wherein said holes are bored through said housing, and wherein a first end of each hole opens to one of each of said chambers, between said first and second ends of the corresponding chamber, and a second end of each hole opens to the outside of said housing, wherein said method comprises the following 5 steps of:

a) inserting said housing in the tumbler-lock-housing receiving cavity of the tool according to any one of claims 4-8;

b) aligning said housing within said cavity;

c) preferably drilling a notch in said housing through a first channel of the first series of channels in said tool;

d) drilling a hole at said notch in said housing through a first channel of the second series of channels; and e) repeating steps c and d for remaining channels in said first and second series of channels.

10. A method according to claim 9, wherein the alignment in step b is performed by positioning the end of the housing planar with the back end of the tool.

11. A method according to claim 9, wherein the alignment in step b is performed by positioning each chamber of the housing aligned with one of each channel in the third series of channels in the tool.

* * * * *